United States Patent [19]

Taub

[11] 4,274,613

[45] Jun. 23, 1981

[54] DISPLAY STAND WITH THREE-SIDED BASE HAVING PARTIAL REAR WALL

[76] Inventor: Ronald H. Taub, 1154 Sheridan Rd., Highland Park, Ill. 60035

[21] Appl. No.: 945,244

[22] Filed: Sep. 25, 1978

[51] Int. Cl.[2] ..... A47G 23/02

[52] U.S. Cl. ..... 248/150; 248/174

[58] Field of Search ..... 248/150, 174, 459; 206/44 R, 44.11, 45.12, 45.21

[56] References Cited

U.S. PATENT DOCUMENTS

| | | | |
|---|---|---|---|
| 1,948,902 | 2/1934 | Carmichael | 248/174 |
| 2,012,117 | 8/1935 | Barron | 248/174 |
| 2,041,751 | 5/1936 | Folsom et al. | 248/174 |
| 2,107,991 | 2/1938 | Thomas | 248/459 |
| 2,571,301 | 10/1951 | Slanhoff | 248/174 X |
| 2,993,295 | 7/1961 | Fischer | 248/459 |
| 3,285,399 | 11/1966 | Snow | 206/44 R |
| 3,438,508 | 4/1969 | Kuns et al. | 206/44 R X |
| 3,836,104 | 9/1974 | Miller | 248/150 |
| 3,926,314 | 12/1975 | Dogliotti | 248/150 X |
| 3,987,737 | 10/1976 | Smith | 248/174 X |

*Primary Examiner*—J. Franklin Foss

*Attorney, Agent, or Firm*—Michael G. Berkman

[57] ABSTRACT

A display stand including a three-sided base formed from a single blank of sheet material and having a partial rear wall. The base comprises a front wall and a pair of side walls, with an upper section of the front wall and a forward segment of each of the side walls being above a generally horizontal cut. The upper section and both forward segments are pivoted rearwardly along vertical fold lines to form the partial rear wall. A rectangular merchandise container is supported by a lower section of the front wall and by the rear wall.

8 Claims, 7 Drawing Figures

DISPLAY STAND WITH THREE-SIDED BASE HAVING PARTIAL REAR WALL

BACKGROUND OF THE INVENTION

The present invention relates to display stands for point of purchase display for merchandise in a shipping container.

Various kinds of display stands for display of merchandise at the point of sale are known in the prior art. However, each of these display stands suffers from one or more disadvantages making it less than completely suitable for its intended purpose.

It is a principal object of the present invention to provide a display stand having a folding base formed from a single blank of sheet material and including a front wall, a pair of side walls, and a partial rear wall.

It is a related object of the present invention to provide the display stand base with interlock means to maintain a rearwardly folded forward segment of each side wall in locking engagement with a fixed rear panel of each side wall.

Another object of the invention is to provide means for stabilizing a rectangular merchandise container suoported on the display stand base.

Additional objects and advantages of the present invention will become apparent to persons skilled in the art from the following specification, taken in conjunction with the drawings.

OUTLINE OF THE DRAWINGS

BRIEF DESCRIPTION OF THE INVENTION

Figure 1:
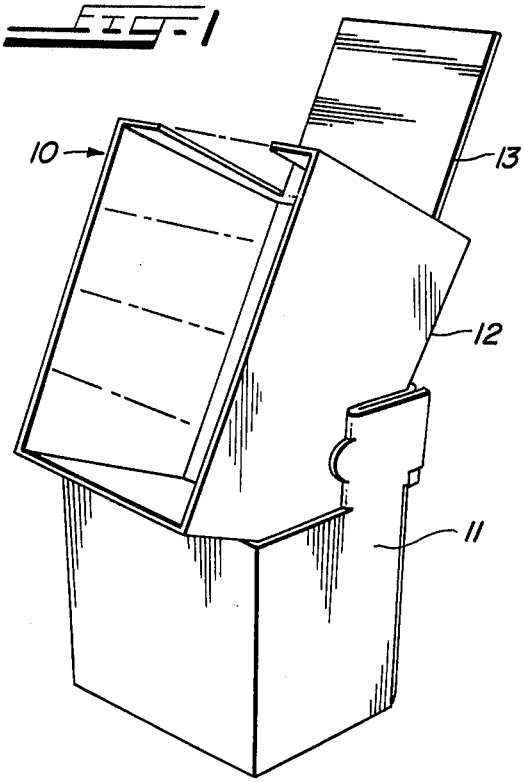
FIG. 1 is a perspective view of a preferred embodiment of a display stand of the invention.
Figure 2:
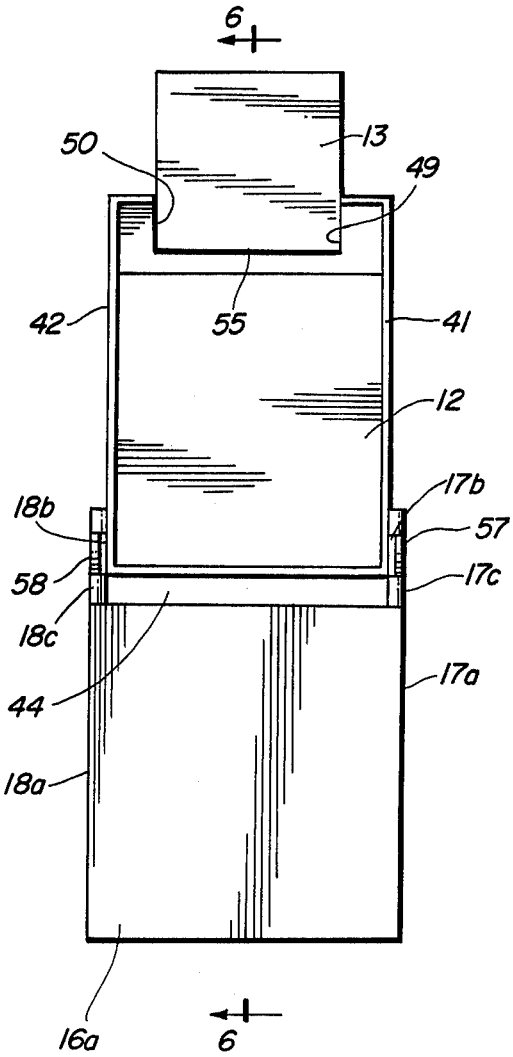
FIG. 2 is a front elevational view thereof.
Figure 3:
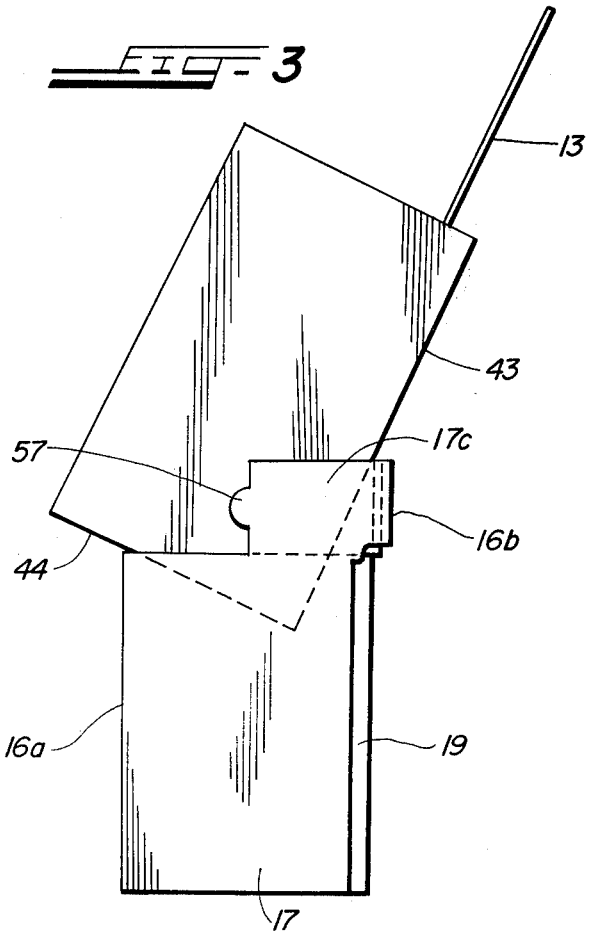
FIG. 3 is a side elevational view thereof.

A complete display stand 10 of the invention in assembled form is illustrated in FIG. 1. The display stand 10 includes a base 11, a rectangular merchandise container 12 supported by the base 11, and a header card 13 extending upwardly of the container 12. For clarity of illustration articles of merchandise usually held in the container 12 have been removed.

Figure 7:
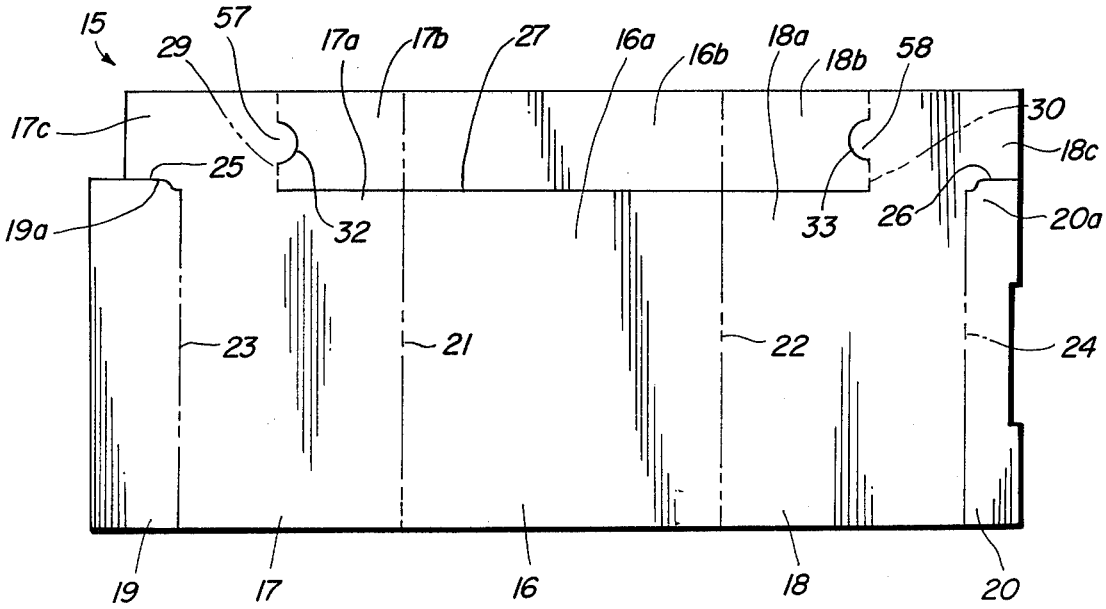
FIG. 7 is a top plan view of a pre-cut and pre-stored blank for constructing the display stand base of the invention.

The display stand base 11 is formed from a single pre-cut and pre-scored blank 15 of sheet cardboard, shown in FIG. 7. The blank 15 includes a front wall 16, a pair of side walls 17, 18 joined to the front wall 16 at lateral marginal limits thereof, and a pair of wing flaps 19, 20 joined to lateral marginal limits of the side walls 17, 18. Each juncture of the front wall 16 with the side walls 17, 18 is defined by a pre-scored vertical fold line 21, 22. Junctures between lateral limits of the side walls 17, 18 with the wing flaps 19, 20 are likewise defined by pre-scored lateral fold lines 23, 24. Upper portions of the wing flaps 19, 20 are separated from the side walls 17, 18 by through slits 25, 26 extending inwardly and downwardly a short distance from lateral edges of the flaps 19, 20.

A horizontal cut 27 is made through the full lateral expanse of the front wall 16 and laterally through portions of the side walls 17, 18. This horizontal cut 27 divides the front wall 16 into a lower section **16*a* and an upper section 16*b*. The cut 27 also divides the side walls 17, 18 into fixed segments 17*a*, 18*a* and pivotal forward segments 17*b*, 18*b*. The pivotal forward segments 17*b*, 18*b* are rearward continuations of the upper section 16*b* of the front wall 16, and are joined to the upper section 16*b* along respective vertical fold lines 21, 22**.

A pre-scored vertical hinge line 29, 30 extends upwardly of each lateral limit of the horizontal cut 27 to upper terminal edges of the side walls 17, 18. These hinge lines 29, 30 divide portions of the side walls 17, 18 above the cut 27 into forward segments **17*b*, 18*b* and rear panels 17*c*, 18*c*. Generally semicircular slits 32, 33 having upper and lower termini on the hinge lines 29, 30 extend into the forward segments 17*b*, 18*b***.

Referring now to FIGS. 2–6, the display stand base 11 is constructed from a blank 15 by folding side walls 17, 18 rearwardly of the front wall 16 along vertical fold lines 21, 22 to form a three-sided structure. Forward segments **17*b*, 18*b* of the side walls 17, 18 are pivoted rearwardly along vertical hinge lines 29, 30 to convert the upper section 16*b* of the front wall 16 into a partial rear wall 16*b*. Pre-scored vertical fold lines 21, 22 are between the rear wall 16*b* and forward segments 17*b*, 18*b* of the side walls 17, 18. The forward segments 17*b*, 18*b* extend forwardly of the rear wall 16*b* along these fold lines 21, 22**.

Figure 4:
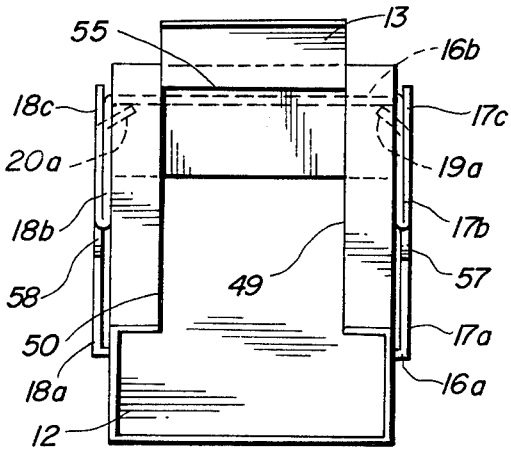
FIG. 4 is a top plan view thereof.
Figure 5:
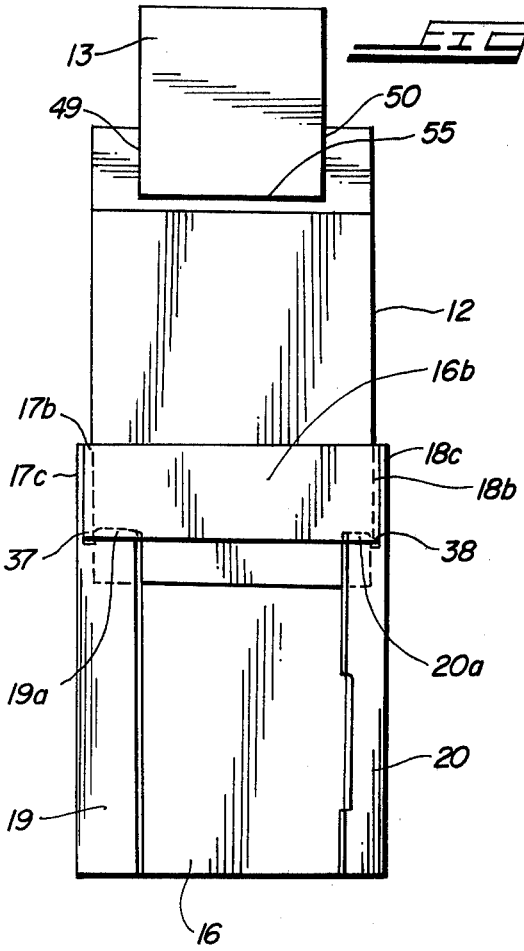
FIG. 5 is a rear elevational view thereof.
Figure 6:
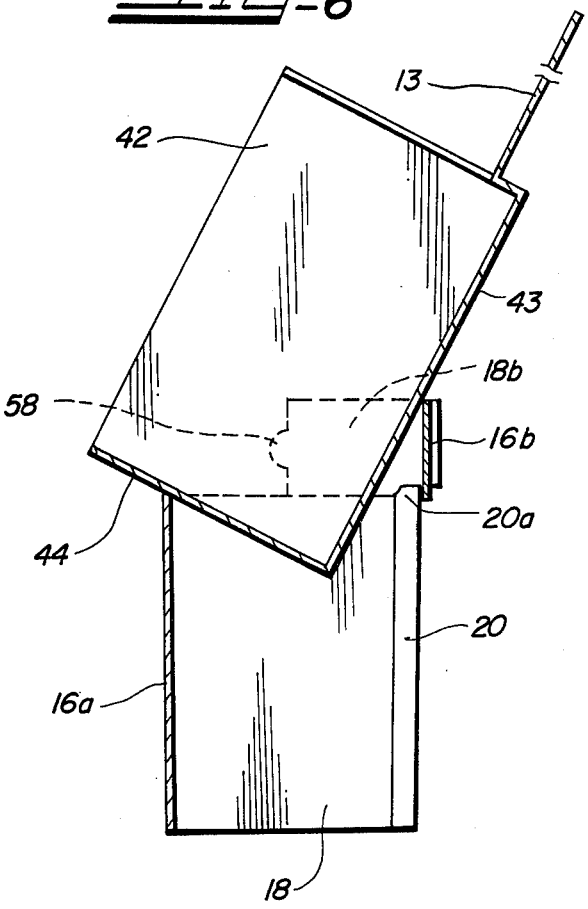
FIG. 6 is a lateral cross-sectional view taken along the lines 6—6 of FIG. 2.

The wing flaps 19, 20 are bent inwardly of the side walls 17, 18 along vertical fold lines 23, 24, as shown in FIGS. 4–6. An upper portion of each flap 19, 20 comprises a wing tab **19*a*, 20*a* for interlocking forward segments 17*b*, 18*b* with contiguous fixed rear panels 17*c*, 18*c* of the side walls 17, 18. Each wing tab 19*a*, 19*b* projects inwardly of the side walls 17, 18 above the level of the horizontal cut 17. The wing tabs 19*a*, 19*b* define upwardly opening, vertical slots or slot means 37, 38 in a zone of juncture with the side walls 17, 18, as shown in FIG. 5. Each slot 37, 38 receives downwardly presented free edge portions of the forward segments 17*b*, 18*b*, thereby maintaining them in locking engagement with the fixed panels 17*c*, 18*c*. Rear edge portions of the wing tabs 19*a*, 19*b* abut resiliently against the rear wall 16*b*. The interlocking relationship of the wing tabs 19*a*, 19*b* with the side walls 17, 18 constitutes interlock means for stabilizing the base 11** against inadvertent collapse.

A generally rectangular, forwardly open merchandise container 12 is supported by the base 11. The container 12 is positioned interiorly of the side walls 17, 18 with lateral walls 41, 42 of the container 12 abutting against the rearwardly folded forward segments **17*b*, 18*b*. A bottom wall 43 of the container 12 rests against an upper edge portion of the rear wall 16*b* of the base 11, and an anterior wall 44 abuts against a top edge portion of the fixed lower section 16*a* of the front wall. A top wall (not shown) has been removed to expose face portions of articles held in the container 12**.

The container 12 also has a posterior wall 45 joined to the bottom wall 43 and lateral walls 41, 42. The posterior wall 45 defines a pair of parallel, generally coterminous vertical cuts 49, 50 spaced inwardly of the lateral walls 41, 42. In the preferred embodiment shown, the header card 13 is formed integrally with the posterior wall 45 and is joined thereto along a hinge line 55 extending horizontally between lower termini of the cuts 49, 50. The header card 13 constitutes a central portion of the posterior wall 45, being folded downwardly and posteriorly along the horizontal hinge line 55. Optionally, the header card may be formed as an auxiliary structure fastened to and supported by the posterior wall 45. When the header card is a separate structure, a portion of the posterior wall may be used to stiffen and to support the header card.

The side walls 17, 18 are both provided with stabilizer flaps 57, 58 integrally formed with and extending forwardly of the fixed rear panels 17*c*, 18*c*. The flaps 57, 58 each have a generally semicircular front edge 32, 33 projecting forwardly of the hinge line 29, 30. Respective upper and lower termini of the front edges 32, 33 are on the hinge lines 29, 30. By extending the side walls 17, 18 forwardly of the hinge lines 29, 30, the stabilizer flaps 57, 58 stabilize the merchandise container 12 against inadvertent tipping or tilting.

While the foregoing description of my invention has been made with respect to a preferred embodiment, persons skilled in the art will understand that numerous changes, modifications, and alterations may be made therein without departing from the spirit and scope of the following claims.

What is claimed is:

1. A display stand base fabricated from a single blank of sheet material and being collapsible along pre-scored fold lines to provide a compact package for shipment and storage, said base comprising an upstanding front wall and a pair of side walls hingedly joined to said front wall at lateral marginal limits thereof, a juncture of said front wall with opposed said side walls being defined by a pre-scored vertical fold line, each of said side walls extending rearwardly of said front wall at either opposed sides thereof and generally normally thereto, said front wall having a horizontal cut at a predetermined level intermediate upper and lower edges thereof and extending across the full expanse of said front wall to divide said front wall into a rearwardly-shiftable upper section and a fixed lower section, each of said side walls having a horizontal cut extending from a forward edge thereof rearwardly a predetermined distance but terminating short of a rear edge of said side walls, said cut in each of said side walls being an uninterrupted extension of said cut in the front wall and at substantially the same level as said cut in the front wall, said side walls defining at respective rearward limits of each horizontal cut therein a pre-scored vertical hinge line projecting generally normally to and upwardly of said horizontal cut to an upper terminal edge of each of said side walls to divide each of said side walls into a pivotal forward segment and a fixed rear panel, each said pivotal forward segment constituting a physical rearward continuation of said upper section of said front wall and being joined thereto along said vertical fold line, said pivotal forward segment of each of said side walls being folded rearwardly along each corresponding said hinge line to lie contiguously against a corresponding said fixed rear panel, and said shiftable upper section of said front wall being displaced rearwardly of and generally paralleling said fixed lower section of said front wall to form a rear wall for said base.

2. The display stand base of claim 1, and further comprising panel interlock means integrally formed with said side walls at rear edge portions thereof, said interlock means including wing tab means integrally formed with each of said side walls and projecting inwardly thereof above the level of said cut formed in said side walls, and vertical slot means in a zone of juncture of said wing tab means with said side walls, said slot means opening upwardly to receive downwardly presented lower free edge portions of each said rearwardly folded forward segments, and to maintain in locking engagement each said fixed rear panel with each said rearwardly folded forward segment.

3. The display stand base of claim 2, wherein said wing tab means includes a rearwardly directed free edge portion abutting resiliently against said rear wall.

4. The display stand base of claim 1, wherein each said side walls includes a stabilizer flap for stabilizing the position of a merchandise container supported by said base, said flap being integrally formed with said fixed rear panel and projecting forwardly thereof, said flap including a front edge extending forwardly of the vertical hinge line between the forward segment and rear panel of said side walls, said front edge having upper and lower termini proximate said vertical hinge line.

5. The display stand base of claim 4, wherein said front edge of the flap is generally semicircular in contour.

6. A merchandise display stand comprising the display stand base of claim 1 and a generally rectangular merchandise container having an anterior wall abutting against a top edge portion of said fixed lower section of the front wall of the base, a bottom wall abutting against an upper edge portion of said rear wall of the base, and lateral walls adjacent to and interior of said side walls of the base.

7. The display stand of claim 6, wherein said container comprises a posterior wall joined to said bottom wall and to said lateral walls, and wherein said posterior wall defines a pair of parallel generally coterminous vertical cuts, said posterior wall including a hinge line extending horizontally between lower termini of said cuts, a central portion of said posterior wall intermediate said vertical cuts being folded downwardly and posteriorly along said hinge line.

8. The display stand of claim 7, and further comprising a header card fastened to and supported by said central portion of the posterior wall.

* * * * *